United States Patent [19]

Harpaintner

[11] Patent Number: 4,665,377

[45] Date of Patent: May 12, 1987

[54] METHOD OF ADJUSTING THE VALUES OF RESISTORS

[75] Inventor: Alfons Harpaintner, Essenbach, Fed. Rep. of Germany

[73] Assignees: Roederstein Spezialfabriken für Bauelemente der Elektronik; Kondensatoren der Starkstromtechnik GmbH, both of Landshut, Fed. Rep. of Germany

[21] Appl. No.: 651,718

[22] Filed: Sep. 18, 1984

[30] Foreign Application Priority Data

Oct. 5, 1983 [DE] Fed. Rep. of Germany ..... 3336229

[51] Int. Cl.[4] ..... H01C 10/00

[52] U.S. Cl. ..... 338/195; 29/592 R; 29/610 R; 29/620; 338/267; 338/278; 338/308

[58] Field of Search ..... 338/195, 308, 267, 278; 29/592, 610, 620; 427/53

[56] References Cited

U.S. PATENT DOCUMENTS 3,916,144 10/1975 Schuermann ..... 338/195

*Primary Examiner*—A. T. Grimley

*Assistant Examiner*—Jane K. Lau

[57] ABSTRACT

A method of adjusting the values of resistors is described wherein regions of a resistive layer provided on a substrate are removed by means of a laser in dependence on the resistance that is required and/or by cutting marks of a specific shape into the resistive layer. In order to obtain resistors with values which are defined as accurately as possible, and which are free of disturbing inductivity, a point raster is formed in the resistive layer by means of single shots of the laser, with the extent and position of the raster, and/or the spacing between its individual points, and/or the size of the individual points being chosen in relation to the total area of the resistive layer in dependence on the required resistance and further physical values.

6 Claims, 2 Drawing Figures

METHOD OF ADJUSTING THE VALUES OF RESISTORS

Figure 1:
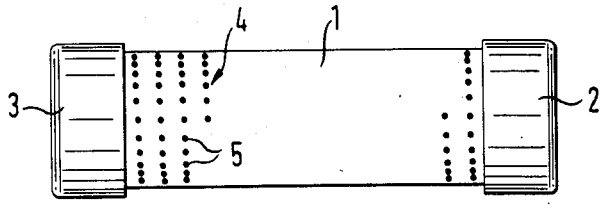

The invention relates to a method of adjusting the values of resistors wherein regions of a resistive layer provided on a substrate are removed by a laser in dependence on the resistance that is required and/or by cutting marks of a specific shape into the resistive layer. The invention also relates to resistors per se.

A method of calibrating film resistors is known, by way of example, from German Auslegeschrift No. DE-AS 23 19 899. This known method is intended to provide a substantially uniform current density distribution along the resistive layer by means of a dashed helical pattern. This helical pattern is generated by means of a laser beam which is operated pulsewise, with the pulse duration of one laser pulse being selected to lie between 0.1 times and 0.9 times the period of the pulsed laser beam in order to obtain the dashed calibration helix in the resistive layer. Each calibration mark which is formed by the laser beam,and which has the form of a short dash or line,is shorter than half the circumference of the cylindrical support body of the resistor. Different dashed helical patterns can be manufactured by varying the ratio between the time of rotation of the film resistor and the periodic duration of the pulsed laser beam. The value of the resistance which can be achieved is in this arrangement proportional to the position of the resistive webs of sequential turns and to the ratio of the width of the resistive web to the length of the calibration marks.

It is a disadvantage of this known method that a change of the electrical values can easily occur during the manufacturing process as a result of the narrowness of the laser tracks due to the penetration of dust, contamination etc. into the laser tracks,and that high step changes in the resistance frequently arise as a result of the manufacturing steps which follow the adjustment of the value, with these step changes being batch-dependent and thus difficult to predict.

The principal object underlying the invention is to develop a method of the initially named kind in such a way that resistors free of disturbing inductance can be manufactured,and simultaneously that a substantial increase of the basic value of the resistance can be obtained in a defined predeterminable manner by treatment by means of a laser beam.

This object is satisfied,in accordance with the invention, in that a point raster is formed in the resistive layer by means of single shots of the laser, with the extent and position of the raster, and/or the spacing between its individual points and/or the size of the individual points being chosen in relation to the total area of the resistive layer in dependence on the required resistance and further physical requirements.

When a cylindrical substrate is present the resistor is set in rotation during the formation of the single shot raster.

By means of the method of the invention it is possible, in comparison to customary methods, to achieve a higher speed of manufacture, higher end values and a broader range of basic values. It is particularly advantageous that no hot spots arise,as a result of the raster distribution over the entire surface,because the raster structure ensures that the conductive tracks are not locally narrowed. The scatter of the end values is likewise very low and generally liessignificantly below 1% after lacquering.

An advantageous development of the invention is characterised in that the thermal distribution can be displaced into the end regions of the resistor by variation of the raster with regard to point spacing and/or point size over the length of the resistor. The heat generated can be dissipated extremely well from the end regions of the resistor via the connection elements, in particular caps.

The method of the invention is also fundamentally suited to the manufacture of narrow tolerance resistors, for which purpose a coarse adjustment of the resistor to its desired value is first effected, the resistor is then lacquered and subsequently baked, a fine adjustment of the resistor is then effected by means of individual laser shots, and a final lacquer coating is then applied to the resistor.

The important advantage of this method lies in the fact that high step changes in value,which frequently and disadvantageously occur with the customary methods, do not occur. The problem of maintaining certain preset values which occurs with the known helical process does not occur with the method in accordance with the invention.

It is sufficient for a particular resistor to be adjusted to approximately −1.5% to −2% of its desired value-,and for it to be adjusted to the precise end value after the application and baking of the primary lacquer coating, in particular by using very fine shots. The resistive layer is protected during the further manufacturing steps against abrasion, and abraded particles, even in the vicinity of any ground edges which may be present. The final lacquering only generates extremely low step changes in value,of for example approximately 0.02%, which are no longer disturbing in practice, with the scatter always remaining very small.

Further important advantages of the method of the invention are: that production is possible rapidly and economically with customary manufacturing apparatus, that adjustment of values greater than 100 k Ω is possible because the end adjustment is distributed over several hundred minute individual raster points,so that a very narrow resistive track can also be treated, and that no track narrowing occurs in the finished resistor which could lead to burning through of the resistor at high loads.

The invention also embraces resistors comprising a substrate or support body, in particular a cylindrical substrate, a resistive layer applied to the substrate and also end face connection elements,with the resistors being characterised in that a point raster which increases the total electrical resistance is formed in the resistive layer. The individual points of the raster are preferably uniformly distributed over at least a part of the area of the resistive layer.

An increased raster point density can in particular be provided in an area of the resistive layer, in particular a centrally disposed area, in order to form a desired breakdown region which has a safety function. By using a resistor of this kind in television apparatus an additional safety can be achieved at minimal effort because a resistor of this kind can take over the function of a substantially more expensive normal fuse.

Further advantageous developments of the invention are set forth in the subordinate claims.

Figure 2:
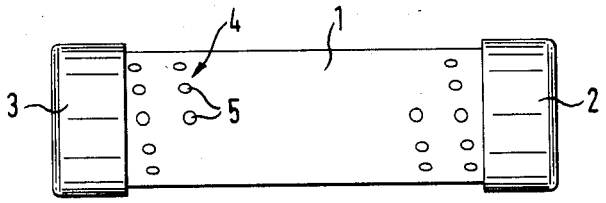

Embodiments of the invention will now be described with reference to the accompanying drawing which shows:

FIG. 1 a schematic illustration of a capped cylindrical resistor with a point raster provided in the region of its two ends, FIG. 2 a representation similar to FIG. 1 of a variant with enlarged raster points, and FIG. 4 is a cross section through the resistor of FIG. 1.

FIG. 1 shows a resistor consisting of a cylindrical support body or substrate with a resistive layer 1 applied thereto, with the resistor being provided with terminal caps 2, 3 at its two ends. In order to produce a noninductive resistance and to achieve a final value which is substantially higher than the basic value,and also as accurate as possible, a point-like raster 4 is introduced into the resistive layer. The point-like raster consists of individual circular raster points 5 which are generated by means of single shots of a laser. In the illustrated embodiment the single shot raster points were produced while the support body was rotating.

In the embodiment of FIG. 2 raster points of larger dimensions are used.The fundamental principle of the point raster is however also retained in this variant.

As already explained the extent and position and/or the spacing between individual points and/or the size of the individual points can be varied depending on the particular task, with it being of particular advantage that this variability, which results in high flexibility, can be achieved without disturbing complexity or expense from a technical manufacturing viewpoint.

The method of the invention makes it possible to overcome a substantial problem in the manufacture of narrow tolerance resistors which lies in the fact that the treatment steps such as welding and lacquering which follow the adjustment increase the scatter of the resistances and lead to non-accurately predictable deviations of the mean value of the particular batch. This problem becomes increasingly serious as the end tolerance values that are demanded become narrower.

The characteric steps of the method of the invention namely coarse adjustment, preliminary lacquering and fine adjustment can be explained with reference to an example as follows:

First of all resistors are calibrated to approximately −2 to −1.5% below the final desired value. This can take place both by means of a laser and also by disk helixing. It is important that stringent requirements do not have to be placed on the scatter of the end values. The coarsely adjusted resistors are lacquered up to the caps, preferably in an automatic preliminary lacquering unit,and are subsequently hardened for approximately 2 hours at 200° C. This first layer of lacquer has a decisive effect on the change in value as a result of migration. The resistors are now protected against abrasion and stabilised to the extent that changes in value as a result of final lacquering are an order of magnitude smaller than during normal customary manufacture.

Fine adjustment is subsequently effected with the resistors being calibrated using the single pulse method in the previously described way, i.e. a continuous cut is not made in the resistive layer but instead the increase in value is effected by a plurality of individual calibration points.

A series of advantages result in connection with this fine adjustment which can be summarised as follows:

No modifications are necessary to the laser which is used for fine adjustment. Very high numbers of resistors can be produced. Each resistor can be supplied as desired and a left hand - right hand marking of the helical pattern is not necessary. No cut-outs are necessary for coarse adjustment. The resistive track is not locally narrowed. No constrictions of the width of the resistive track are present.

There is no local overheating of the resistive track which could lead to temperature coefficient effects. During further processing the fine laser shots do not provide points of attack which could lead to changes in value, although the protective layer of lacquer is missing at these points.

During the next method step, namely the welding, practically no changes in value occur. Finally the final lacquering is carried out with the resistors only being subjected to very low thermal loads,and accordingly the changes in resistive value remain extremely small.

Figure 3:
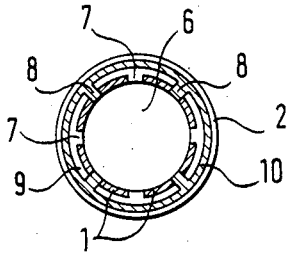

A cross section through the resistor is shown in FIG. 3. The resistor has a core 6, surrounded by a first resistive layer 1 with regions 7 removed for coarse adjustment, and regions 8 removed for fine adjustment, a first layer of lacquer 9, and a second layer of lacquer 10.

I claim:

1. A resistor comprising a substrate having end faces, a resistive layer applied to said substrate, said resistive layer including a point raster of regions removed by a laser beam, connection elements provided at said end faces, a first layer of lacquer disposed over said resistive layer and said point raster of removed regions, a plurality of holes formed by single shots of a laser beam extending through said first layer of lacquer and through said resistive layer; and a second layer of lacquer covering said first layer of lacquer and said holes.

2. A method of adjusting the values of resistors wherein regions of a resistive layer provided on a substrate are removed by means of single shots of a laser to form a point raster of removed regions in dependence on the resistance that is required, wherein a coarse adjustment of the resistor to its desired value is first effected, wherein the resistor is then lacquered and subsequently baked, and wherein a fine adjustment of the resistor is then effected by means of individual laser shots, with at least one of the extent and position of the raster, of the spacing between its individual points, and the size of its individual points being chosen in relation to the total area of the resistive layer in dependence on the required resistance and further physical requirements, and wherein the resistor is finally lacquered.

3. A method in accordance with claim 2, wherein the removal of regions of said resistive layer by means of single shots of said laser is used both for said coarse adjustment and for said fine adjustment of said resistor.

4. A method in accordance with claim 2, wherein the resistor is adjusted during the coarse adjustment to within approximately −1.5% to −2% of its desired value.

5. A method in accordance with claim 2, wherein the fine adjustment is effected with a large number of very fine shots.

6. A method in accordance with claim 5, wherein several hundred individual points are introduced into the resistive layer by means of laser shots during the fine adjustment.

* * * * *